US007178499B2

(12) United States Patent
Wolf et al.

(10) Patent No.: US 7,178,499 B2
(45) Date of Patent: Feb. 20, 2007

(54) LOCOMOTIVE ENGINE GOVERNOR LOW OIL TRIP RESET

(75) Inventors: Daniel Wolf, Erie, PA (US); David Mark Taccone, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/878,744

(22) Filed: Jun. 28, 2004

(65) Prior Publication Data

US 2005/0022784 A1 Feb. 3, 2005

Related U.S. Application Data

(60) Provisional application No. 60/490,625, filed on Jul. 28, 2003.

(51) Int. Cl.
*F02M 1/00* (2006.01)

(52) U.S. Cl. ..... 123/196 S; 123/198 D; 184/6.4

(58) Field of Classification Search ..... 123/196 S, 123/198 D; 184/6.4, 108
See application file for complete search history.

(56) References Cited

U.S. PATENT DOCUMENTS 2,563,834 A 8/1951 Gillispie
4,027,202 A 5/1977 Tyler et al.
RE30,928 E * 5/1982 Fuzzell et al. ..... 123/333
4,413,595 A 11/1983 Potts, Jr.
5,265,567 A 11/1993 Nudds et al.
5,549,097 A * 8/1996 Nimberger ..... 123/690
6,712,651 B2 * 3/2004 Kanno ..... 440/1
2003/0217727 A1 11/2003 Liberatore
2005/0027411 A1 * 2/2005 Meltser et al. ..... 701/19

* cited by examiner

*Primary Examiner*—Thomas Moulis
(74) *Attorney, Agent, or Firm*—Senniger Powers; Carlos Hanze

(57) ABSTRACT

An EMD locomotive engine low oil governor reset system, the governor having a low oil reset plunger which moves from an operating position to a tripped position out of a side of the governor when a low oil condition has been sensed and has initiated shut down of the engine, the governor also providing an electrical signal indicating the plunger has been tripped, the system comprising a solenoid mounted adjacent the governor and having a plunger in alignment with the low oil reset plunger for engaging the plunger in the tripped position and moving it to the operating position when the solenoid is activated, the solenoid being connected to the governor so as to receive the electrical signal therefrom; and a timer associated with the solenoid for delaying activation of the solenoid for a predetermined period of time after receipt of the electrical signal from the governor.

10 Claims, 5 Drawing Sheets

LOCOMOTIVE ENGINE GOVERNOR LOW OIL TRIP RESET

CROSS REFERENCE TO RELATED APPLICATIONS

The invention of the present application claims priority based on U.S. Provisional Application Ser. No. 60/490,625 filed on Jul. 28, 2003.

BACKGROUND OF THE INVENTION

The present invention relates to a governor reset for a low oil trip condition on an EMD locomotive governor and, more particularly, an automatic reset for use in conjunction with an automatic engine restart system.

Railway locomotives are off service for substantial periods of time and are generally shut down when they are not going to be in use for extended time periods. Since some locomotive systems may be harmed if the engine is shut down for too long, there are automated systems designed to stop and restart an engine automatically in the absence of personnel. Whether an engine is being started automatically or manually there are engine protective devices designed to sense certain conditions in an engine's systems during start up and running which will shut an engine down under certain conditions. Unfortunately, and especially after an EMD locomotive engine has been shut down for a long period of time, transient conditions on start-up may be sensed by such protective devices and result in the engine being immediately shut down again. This condition defeats the advantage of an automatic engine start/stop system (AESS) and may require the need for personnel to be available to restart such an engine by overriding the protective devices.

In these protective devices of Electro-Motive Division of General Motors locomotive engines (EMD) there are manual resets which require the presence of qualified personnel to restart the engine, thus often defeating the advantage of an AESS system on such engines. One such device is associated with Woodward engine governors. These governors sense low engine oil pressure and if it is too low the governor shuts the engine down. As it does this it moves a plunger from an operating position to a tripped position which must be reset manually. This essentially defeats an AESS system.

SUMMARY OF THE INVENTION

The present invention overcomes the above described difficulties and disadvantages by providing an automatic system and method for resetting the plunger of a governor low oil reset system.

In a preferred form of the present invention a system is provided for an EMD locomotive engine low oil governor reset system, the governor having a low oil reset plunger which moves from an operating position to a tripped position out of a side of the governor when a low oil condition has been sensed and has initiated shut down of the engine, the governor also provides an electrical signal indicating the plunger has been tripped, the system comprising a solenoid mounted adjacent the governor and having a plunger in alignment with the low oil reset plunger for engaging the plunger in the tripped position and moving it to the operating position when the solenoid is activated, the solenoid being connected to the governor so as to receive the electrical signal therefrom; and a timer associated with the solenoid for delaying activation of the solenoid for a predetermined period of time after receipt of the electrical signal from the governor. The system also preferably provides that the timer delays activation of the solenoid for a sufficient time for the plunger to move to a fully extended position.

In another aspect of the present invention, a method of resetting an EMD locomotive engine low oil governor reset system is provided, the governor having a low oil reset plunger which moves from an operating position to a tripped position out of a side of the governor when a low oil condition has been sensed and has initiated shut down of the engine, the governor also provides an electrical signal indicating the plunger has been tripped, the method comprising utilizing a solenoid mounted adjacent the governor and having a plunger in alignment with the low oil reset plunger for engaging the plunger in the tripped position and moving it to the operating position when the solenoid is activated, the solenoid being connected to the governor so as to receive the electrical signal therefrom; and utilizing a timer associated with the solenoid for delaying activation of the solenoid for a predetermined period of time after receipt of the electrical signal from the governor. This preferred method also preferably includes the timer delaying activation of the solenoid for a sufficient time for the plunger to move to a fully extended position.

DETAILED DESCRIPTION OF THE PREFERRED EMBODIMENT

Figure 1:
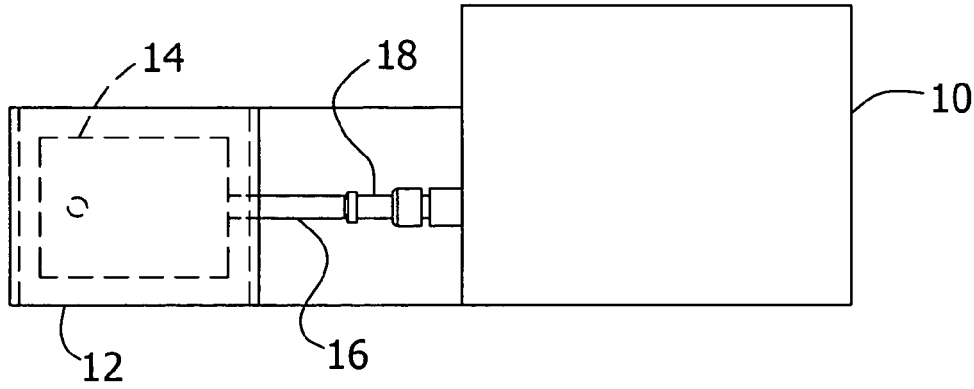
FIG. 1 is a schematic elevational view of a governor and the solenoid and mounting bracket of the preferred embodiment of the present invention with the plunger in the tripped position.
Figure 2:
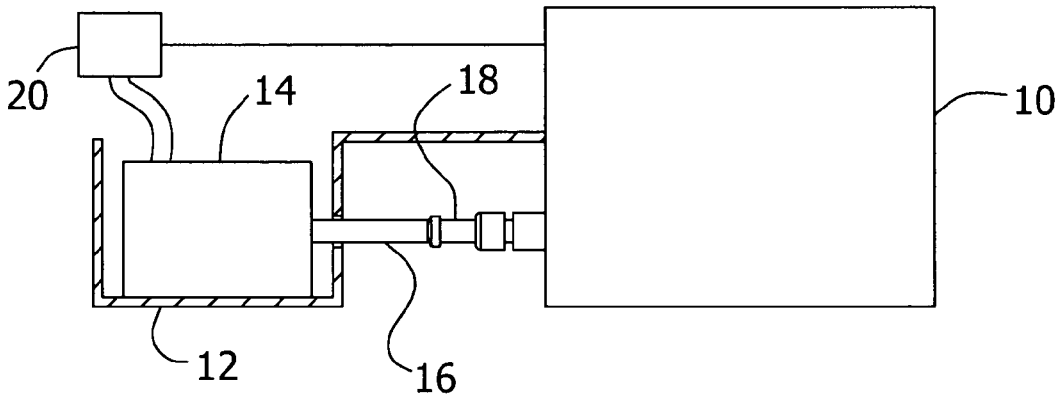
FIG. 2 is a plan view in partial cross-section of the embodiment of FIG. 1 with the plunger in the tripped position.
Figure 3:
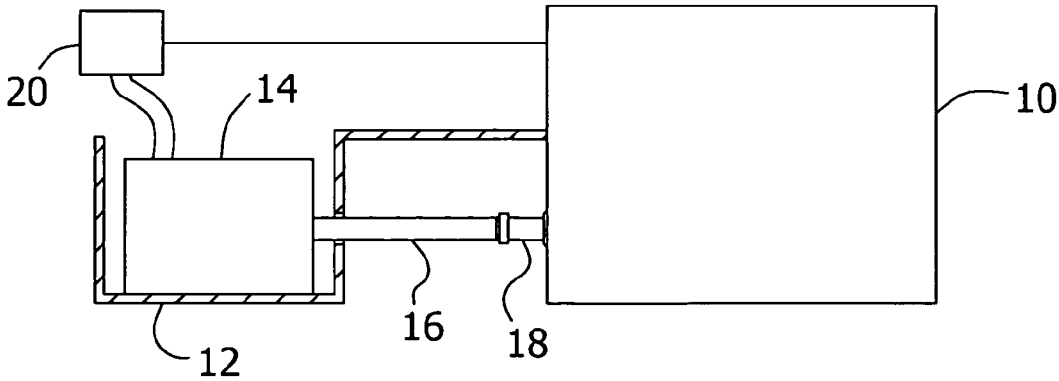
FIG. 3 is a view similar to FIG. 2 with the plunger in the operating position.

As shown in FIGS. 1–3, a Woodward locomotive governor 10 for an EMD locomotive engine is schematically shown, the construction and operation of which is well known in the art. In one embodiment with the present invention, a bracket 12 is mounted to the side of the governor 10 and supports a solenoid 14 having a plunger 16. Plunger 16 is axially aligned with the outer end of a plunger 18 of the governor 10. A solenoid controller 20, as shown in FIGS. 2 and 3 is preferably a computerized controller as part of or associated with an automatic engine start/stop system (AESS) as is generally well known in the art. Controller 20 includes a timer which receives an electrical signal from the governor 10 when the governor sends the signal to shut the engine down.

Figure 4:
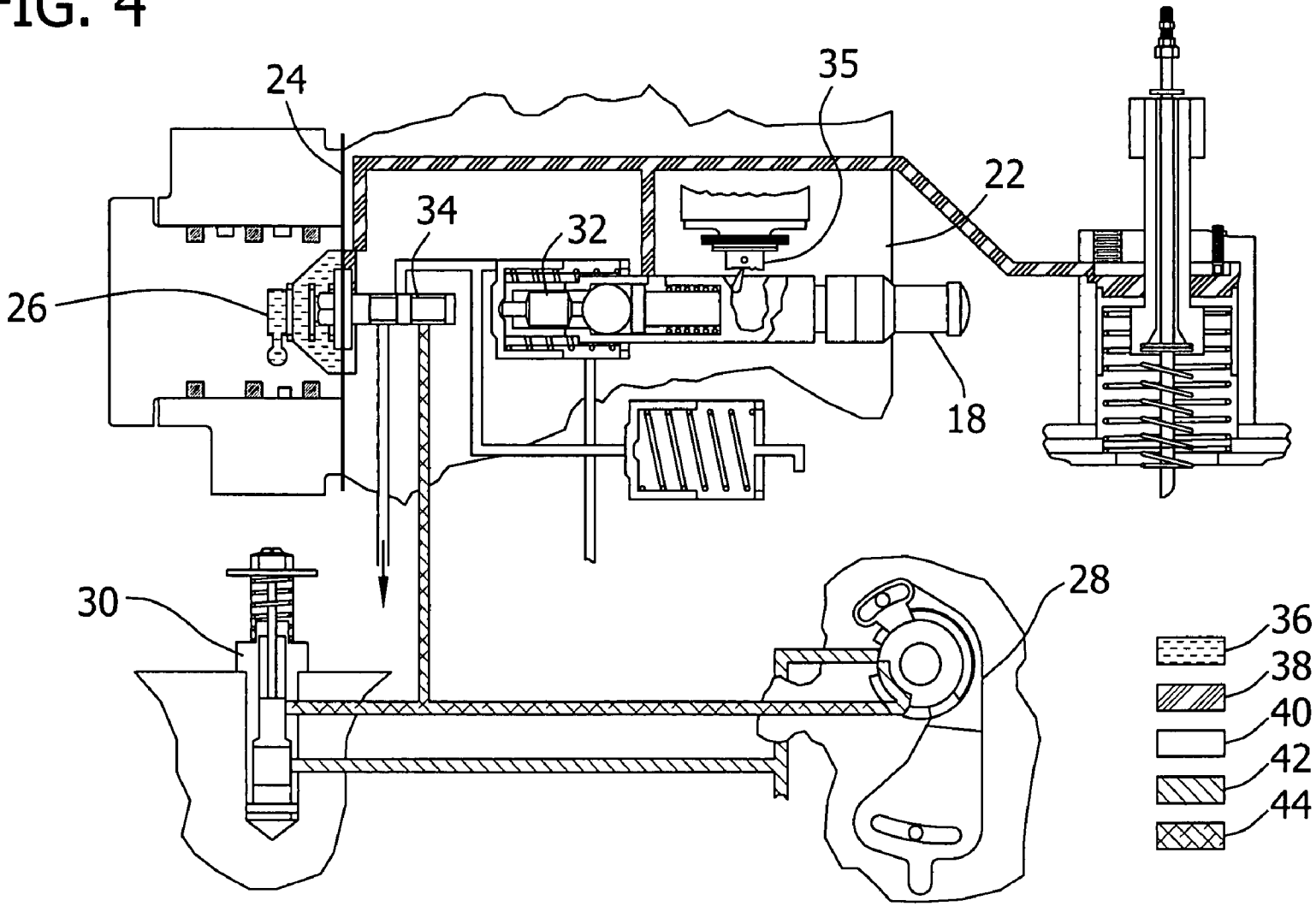
FIG. 4 is a schematic view of a portion of the governor showing the plunger activation circuit.

Plunger 18 is associated with a low engine oil pressure sensing system as schematically illustrated in FIG. 4. Plunger 18 is positioned and arranged to extend from a wall 22 of governor 10. Although such governors are well known in the art and will not be explained in detail herein, the basic components include an oil failure Diaphragm 24, and engine oil pressure inlet 26, a time delay adjustment mechanism 28 with a time delay bypass mechanism 30. The governor also includes an oil failure piston 32 operatively associated with plunger 18 and an oil failure plunger 34. An alarm switch 35 engages plunger 18 and is activated when the plunger is extended. The path of the engine pressure oil is identified by hatching 36, the path of trapped oil under pressure is identified by hatching 38, the path of governor sump oil is identified by hatching 40, the path of governor oil pressure is identified by hatching 42 and the path of intermittent governor oil pressure is identified by hatching 44.

The engine governor 10 monitors engine oil pressure. A connection to the governor is made from a remote point of the diesel engine lubrication system to a diaphragm in the shut down device shown schematically at 24 in FIG. 4. This diaphragm is acted upon by three forces: engine lubrication oil pressure, the diaphragm load spring, and oil pressure from the speed setting cylinder. When engine oil pressure drops below a predetermined safe point the speed setting oil pressure will move the diaphragm allowing governor oil pressure to actuate a shut down piston, thus dumping governor oil to the sump and shutting down the engine. When the shutdown piston actuates it trips the alarm switch 35 and forces the shutdown plunger 18 to extend from the governor housing to provide a visual indicator of a low engine oil pressure trip.

When the governor 10 is tripped by low oil pressure, plunger 18 slowly (taking at least one or two seconds) extends from the wall 22 of the governor 10 under hydraulic pressure produced by the engine. As the engine shuts down the oil pressure dissipates. While the plunger 18 is being extended the solenoid 14 does not have sufficient power to overcome the hydraulic pressure extending plunger 18. However, when the engine stops, or nearly stops, the hydraulic pressure decreases substantially and the solenoid 14 can easily push the plunger 18 from the extended or tripped position shown in FIG. 2, to the operating position shown in FIG. 3.

Figure 5:
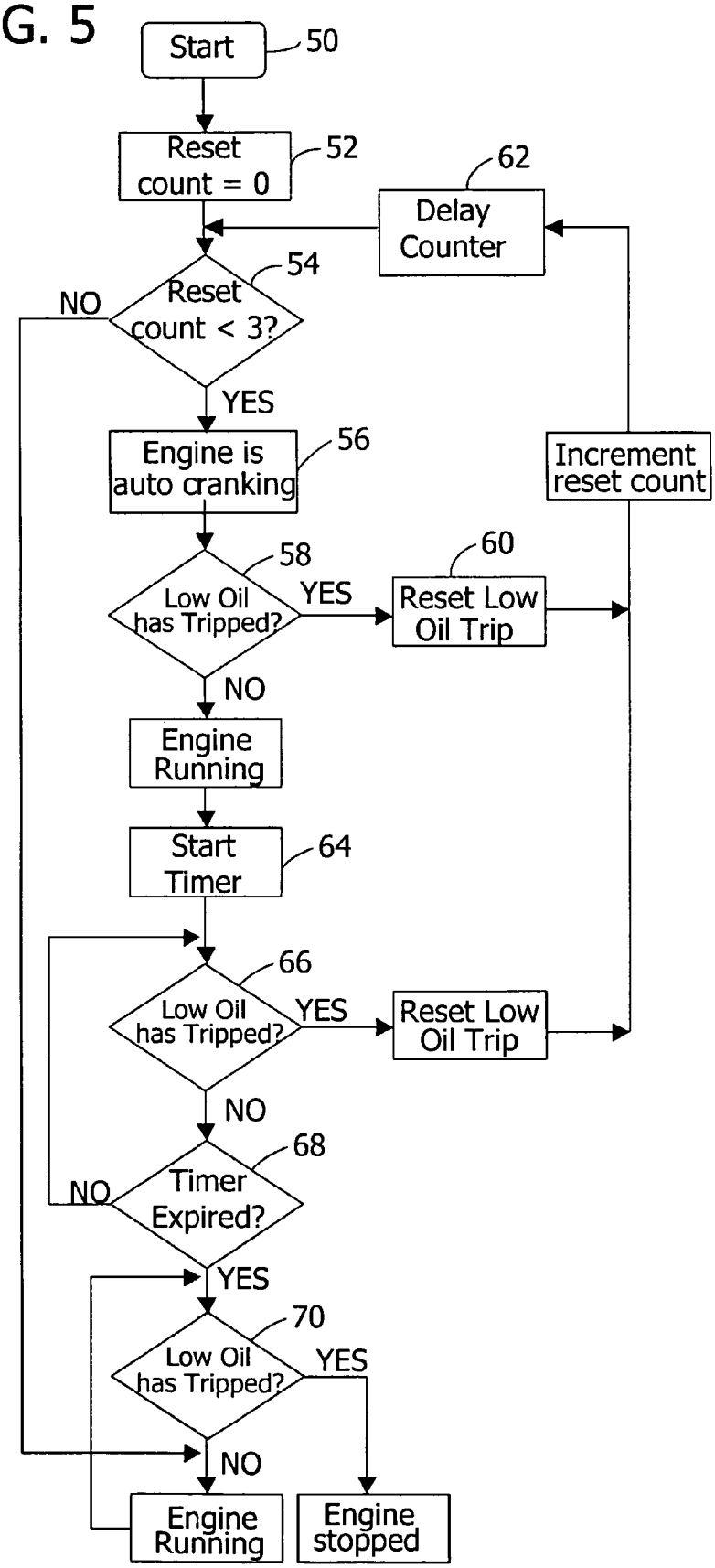
FIG. 5 is a flow diagram showing the logic for the controller during an AESS restart and for a time period after engine start.

Referring now to FIG. 5, a flow chart is shown for the computer controller 20 so far as its control over the solenoid 14 and the timing of operation of the solenoid during an AESS restart of an EMD engine is concerned. The computer initiates a start sequence at the start block 50 which sends a signal to reset a counter 52 to zero and then a signal proceeds to a decision block 54 to determine if the reset count is less than three. If it is less than three a signal is sent to continue engine autocranking at block 56. A determination is then made at block 58 whether the low oil reset has tripped which is determined by a receipt of the signal from the governor 10 given to computer controller 20. If the reset has tripped the governor reset sequence will be initiated at block 60 and a delay counter at block 62 will be incremented for approximately one to two seconds after the governor 10 has been tripped in order to allow the plunger 18 to become fully extended and for the engine cranking to have substantially stopped. The computer controller 20 will then renew its determination at block 54 as to whether the reset count is greater than three and determine again at block 58 whether or not the low oil indicator has tripped in the governor 10. If the low oil indicator in the governor 10 has not tripped the engine will continue running and a start timer at block 64 will be initiated. After the timer is initiated an other determination is made at block 66 as to whether or not the low oil indicator has tripped and if it has the reset process will again be initiated. If the low oil indicator has not been tripped at this point, a determination is made at block 68 as to whether the timer has expired. If not it will continue to check at block 66 whether or not the low oil indicator has tripped until it is determined at block 68 that the timer has expired. At this point a further determination will be made at block 70 as to whether or not the low oil indicator has been tripped and if it has the engine will be stopped and if it has not the engine will continue running. As with the manual starting procedure, this process will continue for no more than 20 seconds if the engine has not started and then the engine will be allowed a cool down period of approximately 50 seconds and then the sequence may be restarted.

Figure 6:
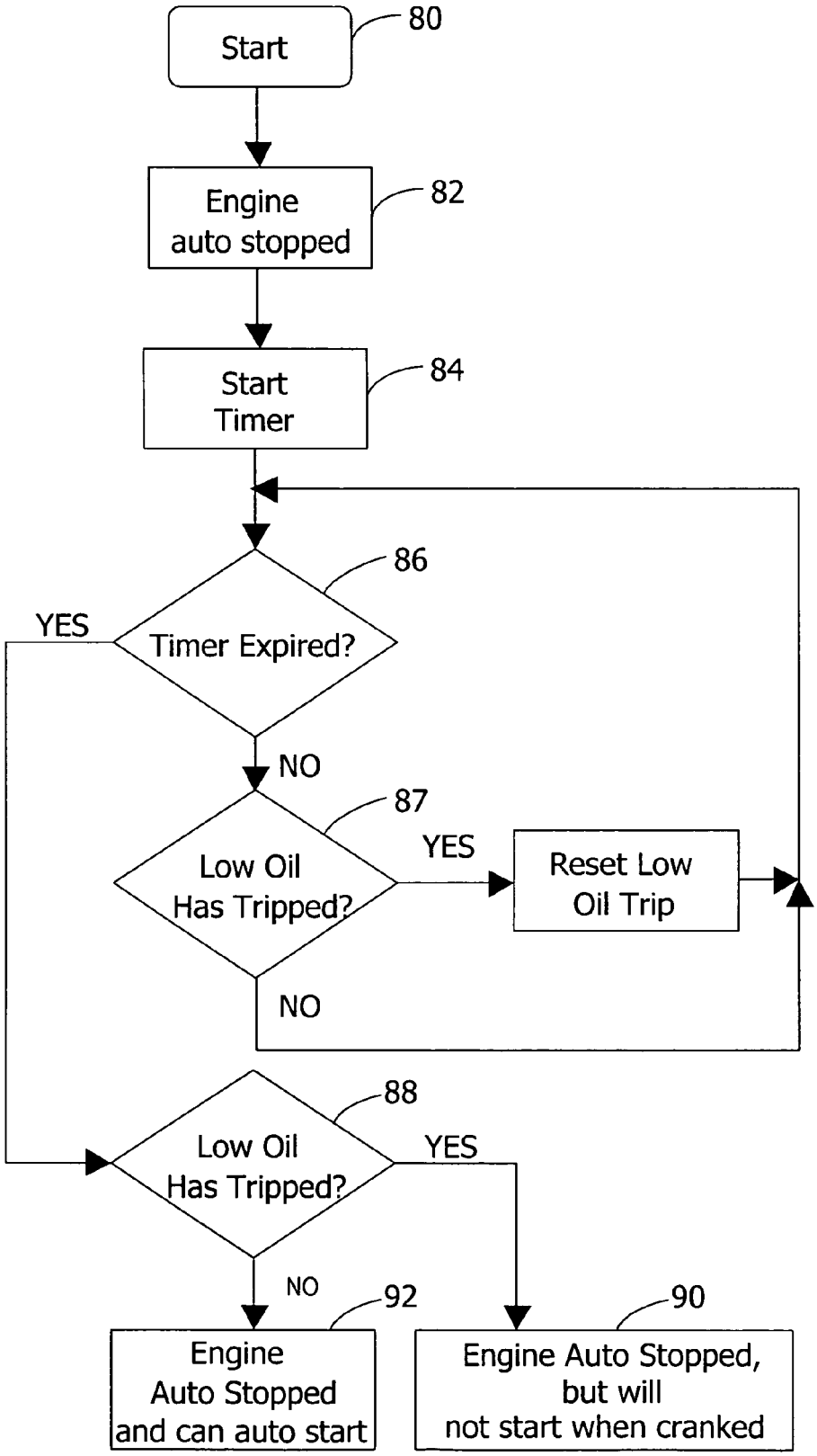
FIG. 6 is a flow diagram showing the logic for the controller after there has been an automatic engine stop.

Referring now to FIG. 6, a flow diagram is indicated for a procedure to reset the governor low oil trip mechanism for a time period after the engine has stopped. The computer controller 20 initiates the sequence at the start block 80 and determines at block 82 if the engine has auto stopped and if so the start timer at block 84 is initiated. A determination is made at block 86 if the timer has expired and if it has the computer controller 20 will determine at block 88 whether or not the low oil indicator of the governor has tripped and if it has the engine is auto stopped at block 90 and will not start when cranked. On the other hand, if it is determined at block 86 that the timer has not expired the computer controller 20 determines at block 87 whether or not the low oil indicator has tripped and if it has it will be reset. If the low oil indicator has not been tripped the computer will again check at block 86 if the timer has expired and continue the sequence as previously described. If it is determined at block 88 that the low oil indicator has not tripped then the engine will be auto stopped at block 92 and can auto restart.

Figure 7:
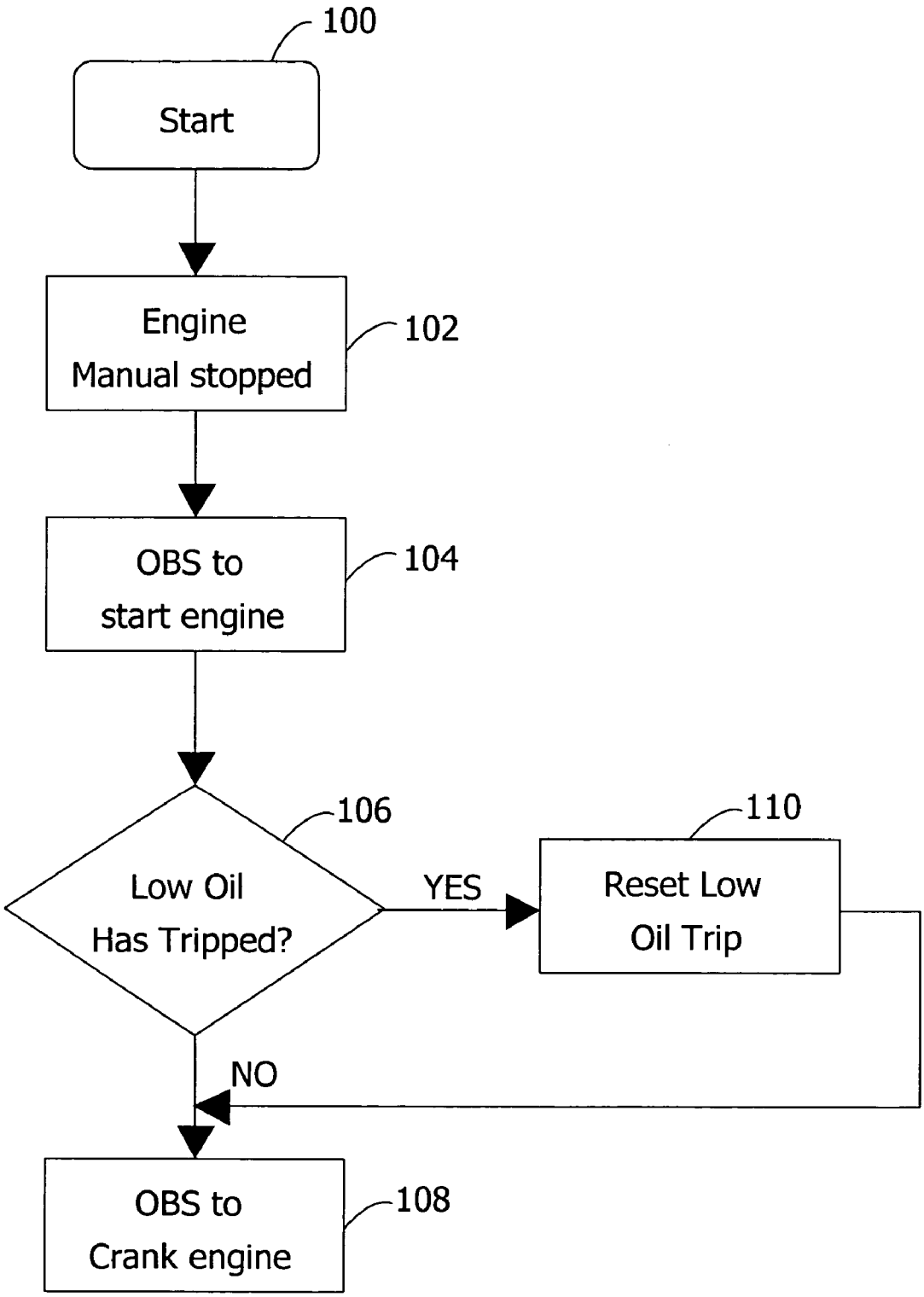
FIG. 7 is a flow diagram with a single attempt restart system.

Referring now to FIG. 7, a flow diagram is illustrated for computer control of the low oil governor reset with a one button start system. The computer controller 20 initiates the operation at start block 100 where the engine is manually stopped at block 102 and the onboard systems (OBS) are utilized by an operator to start the engine at block 104. The computer controller 20 then determines at block 106 if the low oil indicator has been tripped and if not the onboard systems are allowed to continue to crank the engine at block 108. However, if the low oil indicator has been tripped the solenoid 14 is operated at block 110 to reset the low oil indicator in the governor which allows the onboard computer 20 to continue to crank the engine.

When introducing elements or features of the present invention or the preferred embodiment(s) thereof, the articles "a", "an", "the" and "said" are intended to mean that there are one or more such elements or features. The terms "comprising", "including" and "having" are intended to be inclusive and mean that there may be additional elements or features other than those listed.

As various changes could be made in the above embodiments without departing from the scope of the invention, it is intended that all matter contained in the above description or shown in the accompanying drawings shall be interpreted as illustrative and not in a limiting sense.

What is claimed is:

1. An locomotive engine low oil governor reset system, the governor having a low oil reset plunger which moves from an operating position to a tripped position out of a side of the governor when a low oil condition has been sensed and has initiated shut down of the engine, the governor also providing an electrical signal indicating the plunger has been tripped, the system comprising:

a solenoid mounted adjacent the governor and having a movable member for moving the low oil reset plunger from its tripped position to its operating position when the solenoid is activated, the solenoid being connected to the governor so as to receive the electrical signal therefrom and initiate action of the solenoid.

2. The system of claim 1, including:

a timer associated with the solenoid for delaying activation of the solenoid for a predetermined period of time after receipt of the electrical signal from the governor.

3. The system of claim 2 wherein the timer delays activation of the solenoid for a sufficient time for the plunger to move to a fully extended position.

4. The system of claim 3 including a computer controller.

5. The system of claim 4 wherein during solenoid activation the computer continues to monitor whether or not the low oil reset has been tripped and if so determines if the engine should be shut down or, if it has not been tripped, continues to allow the engine to run.

6. The system of claim 1 wherein locomotive engine is an EMD locomotive engine.

7. A method of resetting a locomotive engine low oil governor reset system, the governor having a low oil reset plunger which moves from an operating position to a tripped position out of a side of the governor when a low oil condition has been sensed and has initiated shut down of the engine, the governor also providing an electrical signal indicating the plunger has been tripped, the method comprising:

utilizing a solenoid mounted adjacent the governor for moving the low oil reset plunger from its tripper position to its tripped position and moving it to the operating position when the solenoid is activated, the solenoid being connected to the governor so as to receive the electrical signal therefrom; and using a timer associated with the solenoid for delaying activation of the solenoid for a predetermined period of time after receipt of the electrical signal from the governor.

8. The method of claim 7 wherein the timer delays activation of the solenoid for a sufficient time for the plunger to move to a fully extended position.

9. The method of claim 8 including using a computer controller, to operate the solenoid.

10. The method of claim 9 wherein during solenoid activation the computer monitors whether or not the low oil reset has been tripped and if so determines if the engine should be shut down or, if it has not been tripped, continues to allow the engine to run.

* * * * *